US009254416B2

(12) United States Patent
Ashby

(10) Patent No.: US 9,254,416 B2
(45) Date of Patent: Feb. 9, 2016

(54) TOUCHSCREEN EXERCISE DEVICE CONTROLLER

(71) Applicant: ICON Health & Fitness, Inc., Logan, UT (US)

(72) Inventor: Darren C. Ashby, Richmond, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 192 days.

(21) Appl. No.: 13/860,189

(22) Filed: Apr. 10, 2013

(65) Prior Publication Data

US 2013/0274065 A1 Oct. 17, 2013

Related U.S. Application Data

(60) Provisional application No. 61/622,817, filed on Apr. 11, 2012.

(51) Int. Cl.

| | |
|---|---|
| ***A63B 24/00*** | (2006.01) |
| ***A63B 15/02*** | (2006.01) |
| ***A63B 71/00*** | (2006.01) |
| ***A63B 22/02*** | (2006.01) |
| ***A63B 71/06*** | (2006.01) |

(52) U.S. Cl.

CPC ..... *A63B 24/00* (2013.01); *A63B 24/0087* (2013.01); *A63B 71/0619* (2013.01); *A63B 22/0235* (2013.01); *A63B 2071/0658* (2013.01)

(58) Field of Classification Search

CPC ..... A63B 24/00; A63B 24/0087; A63B 2024/009; A63B 2024/0093

USPC ..... 482/1, 4–9, 54; 345/174

See application file for complete search history.

(56) References Cited

U.S. PATENT DOCUMENTS

| | | | | |
|---|---|---|---|---|
| 7,352,365 | B2 * | 4/2008 | Trachte | G06F 3/0202 345/156 |
| 7,369,121 | B2 * | 5/2008 | Lane | G06F 3/021 341/34 |
| 8,047,965 | B2 | 11/2011 | Shea | |
| 8,260,858 | B2 * | 9/2012 | Belz | A63F 13/12 163/40 |
| 2006/0240947 | A1 * | 10/2006 | Qu | A63B 24/0084 482/1 |
| 2007/0038137 | A1 | 2/2007 | Arand et al. | |
| 2007/0225119 | A1 | 9/2007 | Schenk | |
| 2007/0298935 | A1 | 12/2007 | Badarneh et al. | |
| 2008/0242511 | A1 * | 10/2008 | Munoz | A63B 22/02 482/5 |
| 2009/0128516 | A1 * | 5/2009 | Rimon | G06F 3/0412 345/174 |
| 2009/0216138 | A1 | 8/2009 | Arand et al. | |
| 2010/0156625 | A1 * | 6/2010 | Ruha | A61B 5/02055 340/539.12 |
| 2010/0289772 | A1 | 11/2010 | Miller | |
| 2010/0304932 | A1 * | 12/2010 | Kolman | A63B 71/0619 482/7 |
| 2011/0143769 | A1 * | 6/2011 | Jones | G06F 1/1624 455/456.1 |

(Continued)

*Primary Examiner* — Loan H Thanh
*Assistant Examiner* — Garrett Atkinson
(74) *Attorney, Agent, or Firm* — Holland & Hart LLP

(57) ABSTRACT

A touchscreen exercise device controller is connected to an exercise device and is used to adjust one or more operational parameters relative to the exercise device. The touchscreen exercise device controller includes a touchscreen that displays one or more exercise device controls for controlling exercise device operations, and receives touch inputs from an exercise device user that indicate which exercise device operations are to be changed. The touchscreen exercise device controller further includes a processing module that generates operational commands for the exercise device based on the received user inputs, and upon determining that one or more of the touch inputs comprises a predefined touch input, modifies at least a portion of the exercise device controls displayed on the touchscreen.

17 Claims, 5 Drawing Sheets

(56) References Cited

U.S. PATENT DOCUMENTS

2011/0283188 A1* 11/2011 Farrenkopf ..... G06F 3/0488 715/702

2011/0283231 A1* 11/2011 Richstein ..... G06F 3/0488 715/810

2012/0071301 A1 3/2012 Kaylor et al.

* cited by examiner

TOUCHSCREEN EXERCISE DEVICE CONTROLLER

CROSS-REFERENCE TO RELATED APPLICATIONS

This application claims priority to U.S. Provisional Patent Application No. 61/622,817 filed Apr. 11, 2012.

TECHNICAL FIELD

This disclosure relates generally to systems, methods, and devices for exercise. More particularly, the disclosure relates to a touchscreen exercise device controller which can be used to control operational settings on an exercise device.

BACKGROUND

Exercise devices are used all over the world. Individuals use exercise devices to relieve stress, improve their health and increase their fitness level. Many exercise devices are used when an individual's schedule or inclement weather prohibits the individual from exercising outdoors. Additionally, some exercise devices, such as treadmills, are used to train for competitions. For instance, distance runners often use treadmills to train for upcoming races. Such training allows the individual to conveniently monitor various aspects of their performance (e.g., pace, speed, distance, time, resistance, etc.) during their training session as many treadmills track and display such information. Additionally, treadmills with adjustably inclining treadbases can also simulate the terrain the user will experience during the upcoming race. As a result, individuals do not have to train at the actual location of an upcoming race to be familiar with the race course.

Treadmills and other exercise devices are typically controlled using various different buttons. The buttons may include up and down buttons for speed to increase or decrease the speed of the device, up and down buttons for incline to increase or decrease the incline of the device, directional buttons to select between predefined workouts, between metric and imperial measurements, on/off buttons and others (potentially for controlling other aspects of the exercise device, or even integrated devices such as music players or televisions). Speed and incline buttons are typically designed to increase or decrease speed or incline in predefined increments (e.g. 0.1 mph or 0.1 degrees). Pushing and holding these buttons increments the speed or incline at the same predefined increment, albeit at a higher rate.

In some cases, these control buttons are provided on a touchscreen. For instance, U.S. Patent Publication No. 2009/0216138 discloses a touchscreen that includes a distribution of virtual control buttons that allow the user to control the exercise device. The touchscreen also displays other pertinent workout data such as time, distance, speed, heart rate and other data. Similarly, U.S. Patent Publication 2012/0071301 specifically discloses an adjustable inclining and declining exercise bicycle that can be controlled using a touchscreen interface. Other touchscreen exercise device controllers that allow for the adjustment of exercise device operational parameters are disclosed in U.S. Patent Publication No. 2007/0298935, U.S. Patent Publication No. 2010/0222178, U.S. Patent Publication No. 2007/0225119, U.S. Patent Publication No. 2007/0038137, and U.S. Patent Publication No. 2010/0289772.

SUMMARY OF THE INVENTION

In one aspect of the disclosure, a touchscreen exercise device controller is usable to adjust one or more operational parameters relative to an exercise device.

In another aspect that may be combined with any of the aspects herein, a touchscreen exercise device controller includes a touchscreen that performs the following: displays one or more exercise device controls for controlling exercise device operations and receives touch inputs from an exercise device user that indicate which exercise device operations are to be changed. The touchscreen exercise device controller also includes a processing module that performs the following: generates operational commands for the exercise device based on the received user inputs and, upon determining that at least one of the touch inputs is a predefined touch input, modifies at least a portion of the exercise device controls displayed on the touchscreen.

In another aspect that may be combined with any of the aspects herein, predefined touch inputs include pinching the touchscreen with at least two fingers.

In another aspect that may be combined with any of the aspects herein, modifying at least a portion of the exercise device controls displayed on the touchscreen includes zooming in from a higher level of control increments to a lower level of control increments.

In another aspect that may be combined with any of the aspects herein, zooming in from a higher level of control increments to a lower level of control increments includes zooming from mile per hour increments to tenth of a mile per hour increments.

In another aspect that may be combined with any of the aspects herein, zooming in from a higher level of control increments to a lower level of control increments includes zooming from half-degree incline increments to tenth of a degree incline increments.

In another aspect that may be combined with any of the aspects herein, a touchscreen exercise device controller includes controls that have a range of numbers spanning from a first number to a second number.

In another aspect that may be combined with any of the aspects herein, zooming in from a higher level of control increments to a lower level of control increments includes zooming in toward the portion of the range of numbers pinched by the user.

In another aspect that may be combined with any of the aspects herein, an exercise device user touches a number on the range of numbers to select a speed for the exercise device.

In another aspect that may be combined with any of the aspects herein, an exercise user touches a number on the range of numbers to select a degree of incline for the exercise device.

In another aspect that may be combined with any of the aspects herein, an exercise user slides a finger over the range of numbers on the touchscreen to change a specified operational setting.

In another aspect that may be combined with any of the aspects herein, an exercise user slides a finger upward over the range of numbers to increase a specified operational setting and downward over the range of numbers to decrease the specified operational setting.

In another aspect that may be combined with any of the aspects herein, at least one of the predefined touchscreen inputs includes touching the touchscreen with at least two fingers and spreading the fingers apart from each other.

In another aspect that may be combined with any of the aspects herein, modifying at least a portion of the exercise device controls displayed on the touchscreen includes zooming out from a lower level of control increments to a higher level of control increments.

In another aspect that may be combined with any of the aspects herein, zooming out from a lower level of control increments to a higher level of control increments includes zooming out toward the portion initially touched by the user.

In another aspect that may be combined with any of the aspects herein, an integrated touchscreen exercise device control system is provided.

In another aspect that may be combined with any of the aspects herein, the integrated touchscreen exercise device control system includes a movable element that is movable during the performance of exercise, the movable element having one or more adjustable operating parameters. The integrated touchscreen exercise device control system also includes a receiver that receives control commands related to the one or more adjustable operating parameters and an actuator that causes the one or more adjustable operating parameters to be adjusted in response to the control commands received by the receiver. The integrated touchscreen exercise device control system further includes an integrated touchscreen exercise device controller that includes a touchscreen that displays exercise device controls for controlling exercise device operations including a range of numbers spanning from a first number to a second number, and receives touch-and-slide inputs from an exercise device user that indicate an updated operational state to which the exercise device is to be changed, and includes a processing module that generates operational commands for the exercise device based on the received touch-and-slide user inputs.

In another aspect that may be combined with any of the aspects herein, touch-and-slide inputs include a user's finger touching the touchscreen at a point along the range of numbers and sliding the finger upward or downward along the range of numbers.

In another aspect that may be combined with any of the aspects herein, the exercise system receives a pinch input from a user and zooms in on the range of numbers at the location of the pinch.

In another aspect that may be combined with any of the aspects herein, the exercise system receives a touch-and-spread output from the user and zooms out on the range of numbers at the location of the touch-and-spread.

In another aspect that may be combined with any of the aspects herein, a method for controlling an exercise device using a touchscreen exercise device controller includes running an exercise program on an exercise device, wherein the exercise program controls the one or more operating parameters of the exercise device, and wherein the exercise program is initiated via a user input mechanism on the exercise device. The method also includes displaying one or more exercise device controls for controlling exercise device operations on a touchscreen display and receiving touch inputs from an exercise device user that indicate which exercise device operations are to be changed. The method further includes generating one or more operational commands for the exercise device based on the received touch inputs and upon determining that one or more of the touch inputs includes a predefined touch input, modifying at least a portion of the exercise device controls displayed on the touchscreen.

DETAILED DESCRIPTION

Figure 1:
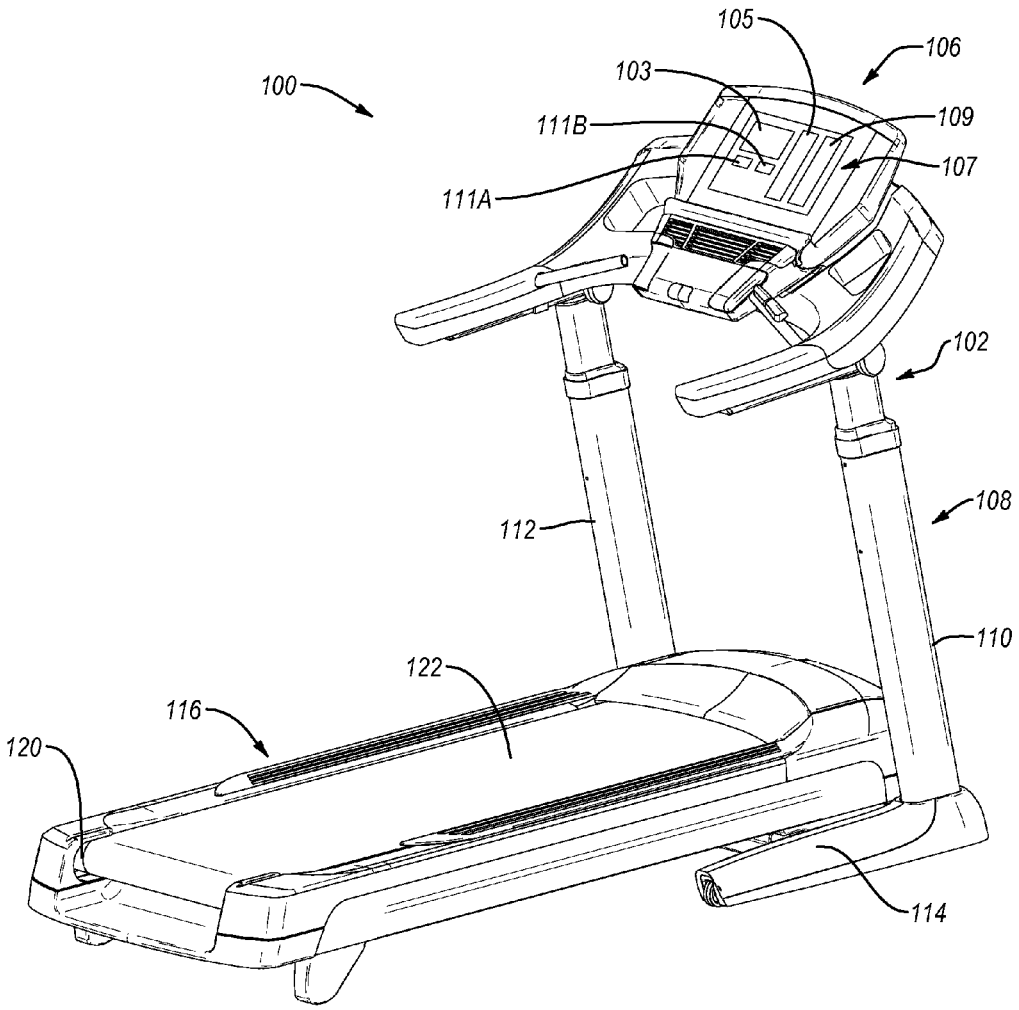
FIG. 1 illustrates an exercise system according to one example embodiment of the present invention.

The present disclosure is directed to systems, methods, and devices for exercise. Depicted in FIG. 1 is a representation of one illustrative exercise system 100, which may incorporate the novel features of the present invention, including various novel devices, functionalities, hardware and software modules, and the like. As shown, exercise system 100 includes an exercise device 102 with an integrated touchscreen exercise device controller 106.

In the illustrated embodiment, exercise device 102 is depicted as a treadmill and includes an integrated touchscreen exercise device controller 106 having user input mechanisms 107 that may be used to control various aspects of exercise device 102. For instance, the integrated touchscreen exercise device controller 106 includes buttons 103, 105, 109, 111A and 111B for controlling operational parameters of the exercise device 102. Each button may perform a different function. Moreover, as the interface is a touchscreen, the buttons are virtual. As such, the buttons can change shape, change configuration, and even change functionality. In some cases, the buttons may be programmable or customizable by a user of the exercise device 102.

Integrated touchscreen exercise device controller 106 is illustrated as being supported on a generally upright support structure 108. Upright support structure 108, in this illustrated embodiment, includes two side members 110, 112 connected to a base frame 114. Side members 110, 112 and base frame 114 may have various configurations and may be fabricated from various materials so long as they are capable of supporting control panel 106.

A treadbase 116 is connected to support structure 108 and typically includes front and rear pulleys 118, 120 with a continuous belt 122 extending between and around front and rear pulleys 118, 120, respectively. Treadbase 116, front and rear pulleys 118, 120, and continuous belt 122 may be considered, individually or collectively, as movable elements that are movable during the performance of an exercise. A deck 124 typically supports the upper run of belt 122 and an exercising individual positioned upon belt 122.

As is common with electric treadmills, at least one of front pulley 118 and rear pulley 120 may be mechanically connected to an actuator, such as an electric belt drive motor 126. In the illustrated embodiment, belt drive motor 126 turns front or rear pulley 118, 120 in order to rotate belt 122. Belt drive motor 126 is electrically connected to a controller 128 that controls the operation of belt drive motor 126, and thus the speed of belt 122, in response to various inputs. The speed of belt 122 is one example of an adjustable operating parameter of exercise device 100.

Controller 128 can be incorporated within treadbase 116, within the integrated touchscreen exercise device controller 106, or within another portion of exercise device 100. Controller 128 may take the form of a computer, a processor, a microprocessor, a microcontroller, a state machine or other similar device that includes circuitry for controlling the operation of one or more features on exercise device 100, including the operating parameter(s) of the movable element(s). As will be discussed in greater detail below, controller 128 may also perform other functions, such as receiving and implementing control commands received from the integrated touchscreen exercise device controller 106.

Figure 2:
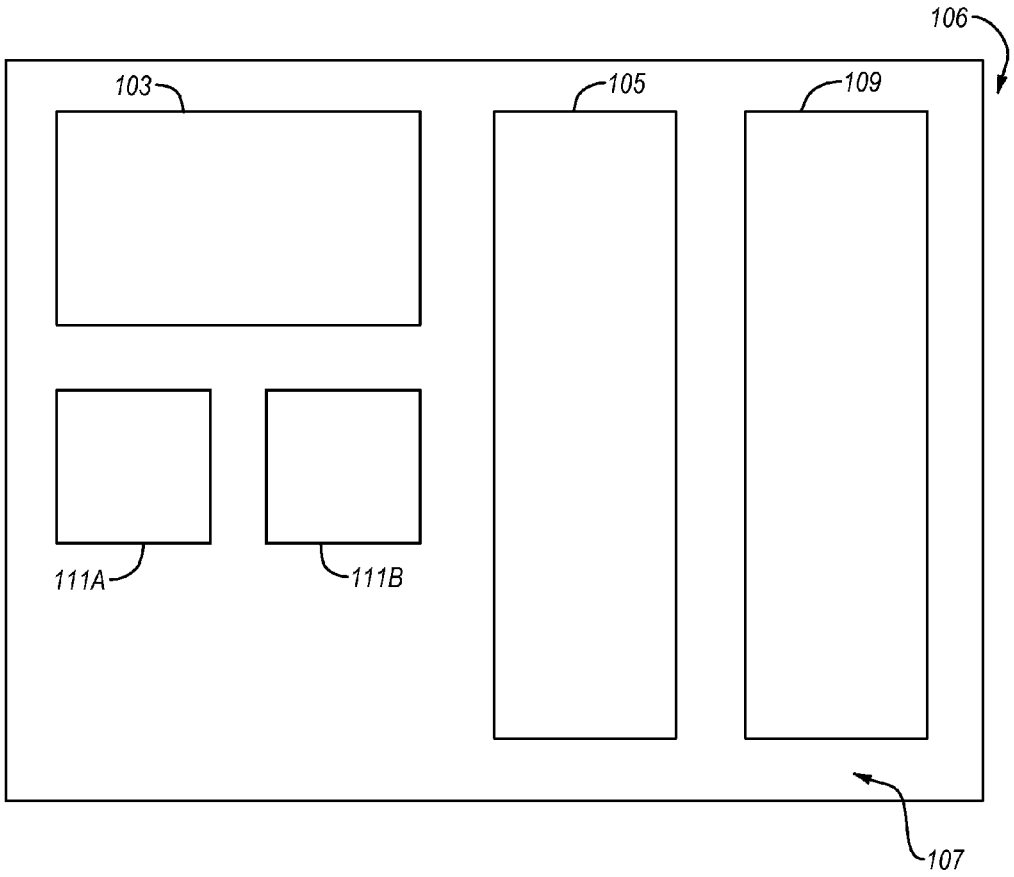
FIG. 2 is a top view of a touchscreen exercise device control panel.

The control commands may come from one or more of the buttons provided by the integrated touchscreen exercise device controller 106. As mentioned above, the integrated touchscreen exercise device controller 106 may include substantially any number of buttons. These buttons may be of varying shapes and sizes. For example, as shown in FIG. 2, the integrated touchscreen exercise device controller 106 may include an on/off button 103, a speed control button 105, an incline control button 109 and other functional buttons 111A and 111B. Once a workout is selected, other information may be displayed on the touchscreen in addition to or in place of the buttons shown. For instance, once the exercise device has been turned on, the on/off button may be replaced or repositioned to display (or more prominently display) distance, time, heart rate, calories burned or other information.

The touchscreen device itself may be any type of capacitive, resistive or other type of touchscreen commonly known in the art. The touchscreen 106 may receive touch inputs from a user including single touch inputs (such as pushing a virtual button), multi-touch inputs (such as two or more fingers touching a button or other feature), gestures such as pinching or spreading two or more fingers or any other type of input. Although described herein as touch inputs, the inputs may come from a stylus, a mouse, a keyboard or other input device or combination thereof.

Figures 3A, 3B, 3C:
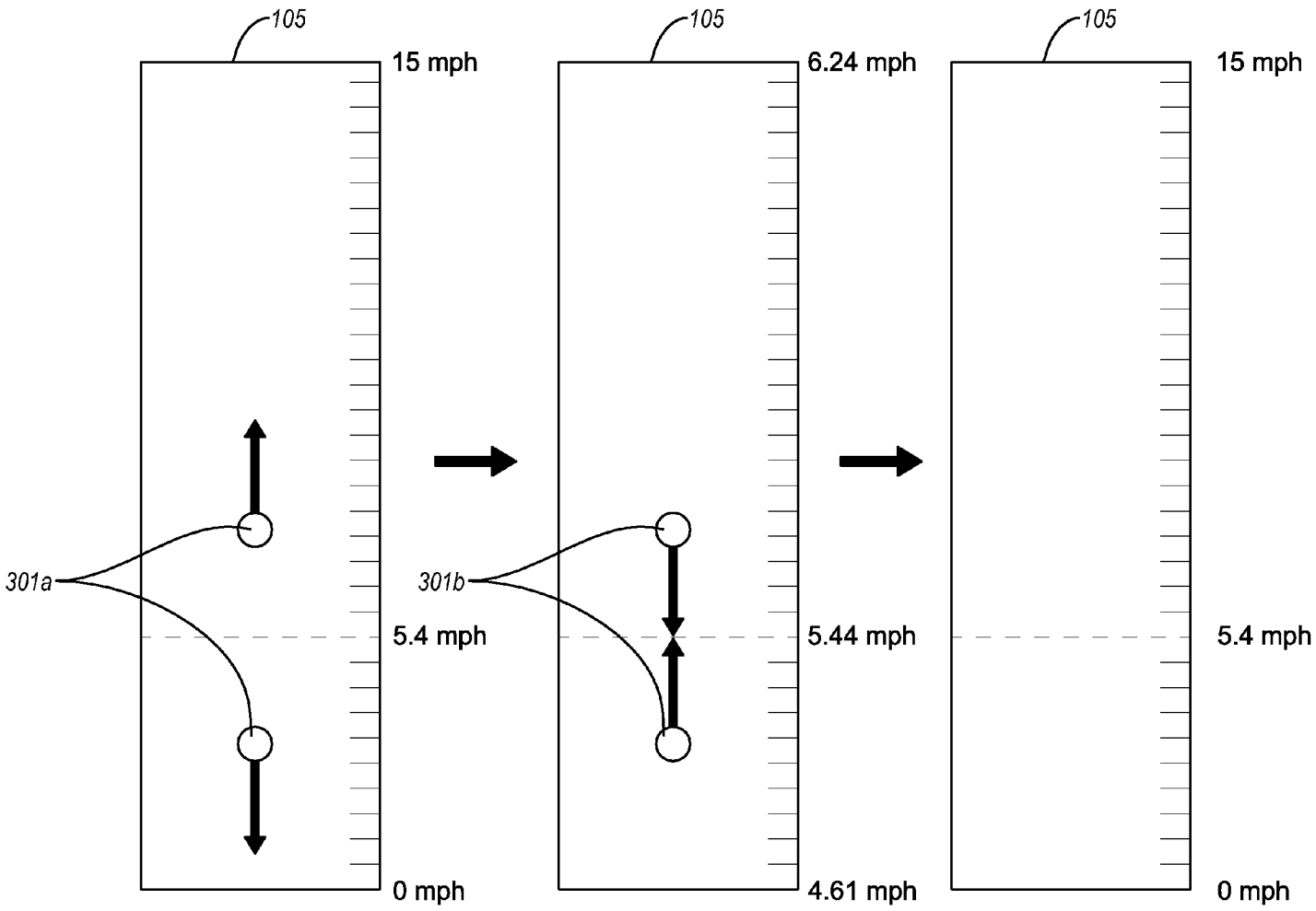
FIGS. 3A, 3B and 3C illustrate alternate views of a range of numbers for controlling exercise device speed.

With continued attention to FIGS. 1 and 2, attention is now directed to FIG. 3, which illustrates an embodiment where an exercise device user zooms in and out of a specified button. As shown in FIG. 2, the integrated touchscreen exercise device controller 106 may include elongated buttons 105 and 109. These buttons may include a range of numbers from a starting number to an ending number. As shown in FIG. 3A, the elongated button may comprises a speed-controlling button 105. The range of numbers may span from zero mph to 15 mph. It will be understood that these numbers were arbitrarily selected, and that the range may include substantially any range of numbers.

The user may wish to control the speed of the exercise device 102, albeit with a finer degree of control than that initially shown. Thus, a user may apply a finger spreading or "spread" input 301A to the button 105. In the example shown in FIG. 3A, the user spreads his or her fingers in the area of the user's current speed (5.4 mph). The result of the spread input 301A is shown in FIG. 3B. The view has zoomed in and the range of numbers has now been changed from a larger range of 0-15 mph to a much smaller range of 4.61-6.24 mph. The button remains substantially the same size, but the range of numbers has decreased commensurate with the degree to which the user spread their fingers (i.e. a small spread would result in a small zoom, while a larger spread (with the fingers travelling a larger distance apart from each other) would result in a larger zoom. A moderate to large zoom may result in a range of numbers with very fine increments. For instance, as shown in FIG. 3B, the increments of speed are now shown in hundredths of a mile per hour, whereas in FIG. 3A, the increments of speed are shown in tenths of a mile per hour. If a user was to zoom further, the increments may be shown in thousandths, ten-thousandths or other even smaller increments. Accordingly, the user may zoom in on the button itself to provide more fine-grained control of the exercise device.

It will be understood that button 105 may show any of a variety of different exercise device operational parameters. Indeed, as will be described further below with relation to FIGS. 4A and 4B, the button may show degrees of incline, time, distance, pace, resistance, predefined workout routines or other operational parameters. Exercise device users may use spread inputs to zoom in to substantially any level of granularity for a particular control. Exercise device users may also use a pinch input to zoom back out. Thus, as shown in FIG. 3B, a user may apply a pinch input 301B near the current speed level (5.44 mph) to zoom back out to the original range, as is shown in FIG. 3C. As with the zooming in, the user may zoom out to substantially any reasonable level. For instance, the user may zoom out to where increments are in whole mile per hour or whole degrees of incline. The user may zoom in or out on any of the buttons 107 on the integrated touchscreen exercise device controller 106 to where the buttons provide the desired level of granularity for that control. As such, a user may have one level of granularity for speed (e.g. button 105) and one level of granularity for incline (e.g. button 109). Each button may be individually configured and set by the user.

Figure 4B:
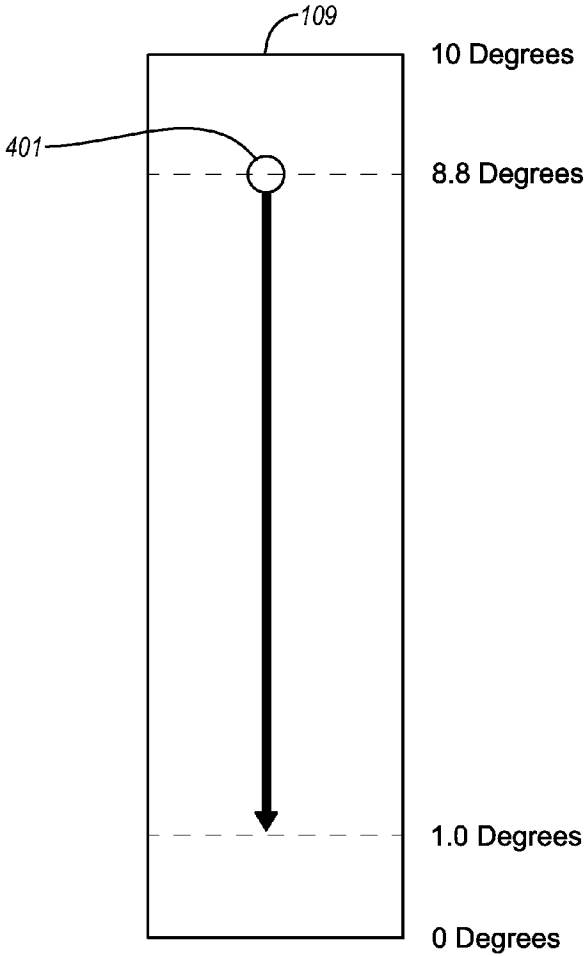
FIGS. 4A and 4B illustrate alternate views of a touch-and-slide range of numbers for controlling exercise device incline.
Figure 4A:
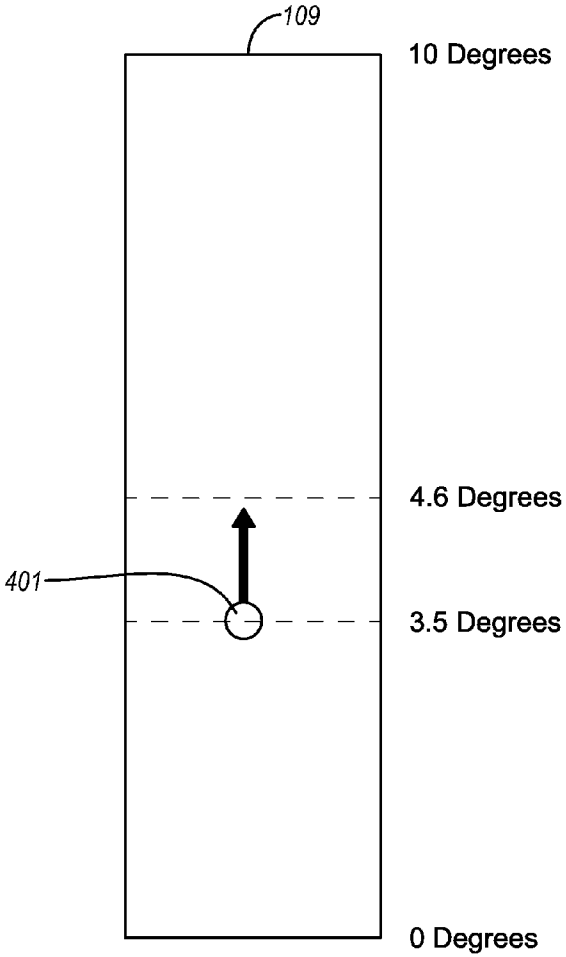

To set a particular speed, incline or other setting, a user may use a touch-and-slide input. For instance, as shown in FIG. 4A, if button 109 is displayed in integrated touchscreen exercise device controller 106, and the user wishes to increase the incline on the exercise device 102 from 3.5 degrees incline to 4.6 degrees incline, the user can touch the line (or other indicator) indicating the current level and slide their finger upward. This touch input 401 allows the user to quickly increase or decrease an operational setting while the exercise device 102 is going. Similarly, as shown in FIG. 4B, a user may use a touch-and-slide input 401 to decrease the incline from 8.8 degrees to 1.0 degrees. This input may be performed quickly so as to provide an immediate adjustment in incline (or in another operational setting). Touch-and-slide inputs may be used in conjunction with pinch and spread inputs, such that a user can zoom to a desired level of granularity for a control, and then control the exercise device using touch-and-slide inputs.

Figure 5:
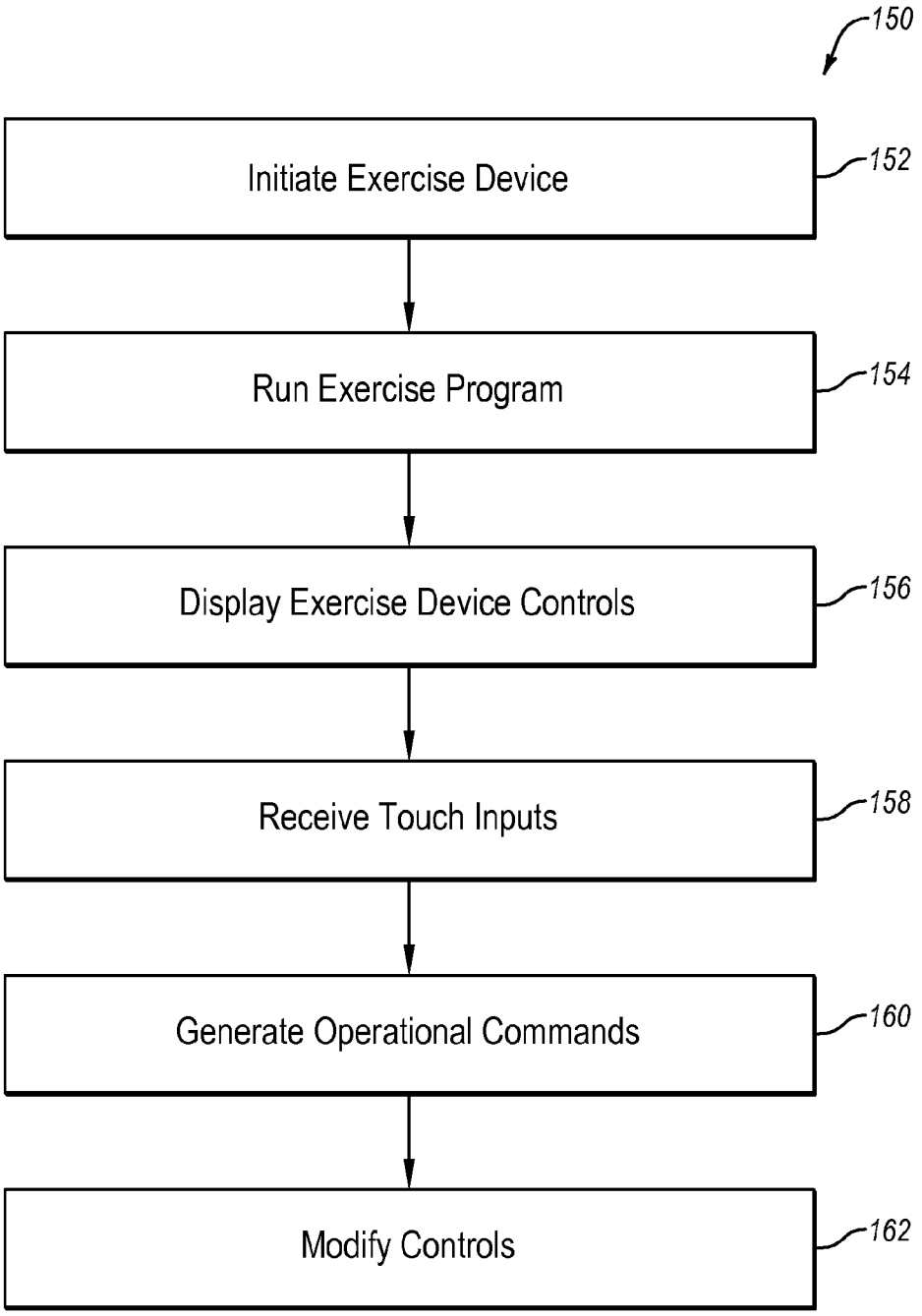
FIG. 5 is a functional block diagram of a process for controlling an exercise device using a touchscreen exercise device controller.

Attention is now directed to FIG. 5, which illustrates a flow diagram of an exemplary method 150 that may be implemented to control an exercise device using an integrated touchscreen exercise device controller. Method 150 may begin with step 152 in which an exercise device (e.g. 102) is initiated and with step 154 in which an exercise program is run. The exercise program may include one or more control commands that adjust the operating parameters of the exercise device. For instance, the exercise program may periodically adjust the resistance, incline, or speed of the exercise device and/or the movable elements of the exercise device to vary the intensity of the exerciser's workout or to simulate a real world course. Alternatively, the exercise program may simply be the initial exercise device settings selected by the exerciser. The running of the exercise program may be initiated via one or more of the user input mechanisms 107 on the exercise device 102.

Method 150 may also include (at step 156) displaying the exercise device controls on the integrated touchscreen exercise device controller 106. The controls allow the user to adjust operational settings on the exercise device 102. As explained above, the controls may include various buttons (e.g. 103, 105, 109, 111A and/or 111B) for controlling different operational parameters. Substantially any number of buttons may be displayed on the touchscreen, and the buttons may be customized by the user. For instance, the user may use touch inputs to zoom in or out on a particular button. The user may also use touch inputs to increase, decrease or otherwise change settings. Still further, at least in some cases, the user may be able to change the spacing, size, orientation or other settings of the displayed buttons.

In step 158, the integrated touchscreen exercise device controller 106 receives touch inputs from the user. These touch inputs may be single touches, multi-touches, gestures or other types of inputs. In step 160, the integrated touchscreen exercise device controller 106 (or a processor in communication therewith) generates operational commands in response to the received inputs (e.g. 301A, 301B or 401). These operational commands control motors settings, actuator settings and setting of other controllable items. These operational commands may be of different granularity. For instance, if a user has zoomed out on a range of numbers (e.g. 105 in FIG. 3A), then the operational commands may be generated in tenths of a mile per hour. On the other hand, if the user has zoomed in on a range of numbers (e.g. 105 in FIG. 3B), the operational commands may be generated in hundredths, thousandths or other fine-grained increments. Accordingly, these operational commands may provide a high level of control over a user's speed, incline, resistance level or other operational setting.

If the user provided one of a variety of different predefined inputs (such as a pinch input or a spread input), the integrated touchscreen exercise device controller 106 will modify the controls in step 162. The controls may be modified to include more increments, less increments, or finer- or coarser-grained increments. The controls may also be modified to provide different functionality. For instance, a user may touch and swipe a button off to the side. That button may be repositioned or removed from the display altogether. In some cases, a user may touch and hold the touchscreen to bring up menus or other options. The interface is thus modifiable according to the user's inputs.

Accordingly, the integrated touchscreen exercise device controller 106 of exercise device 102 may allow exercise device users to control operational parameters of the exercise device using a customizable touchscreen interface.

INDUSTRIAL APPLICABILITY

In general, embodiments of the present disclosure relate to exercise systems, devices, and methods that enable an exerciser to control an exercise device operational parameters using a touchscreen interface. The systems, devices, and methods of the present disclosure allow an exerciser to modify virtual buttons and to quickly adjust operational parameters of an exercise device using touch inputs.

When exercising on an exercise device, an exerciser may desire to adjust one or more operational parameters of the exercise device in order to exercise more effectively. For instance, the exerciser may want to slowly increase or decrease the resistance on a spin bike, or may want to slowly increase or decreases the speed or incline of a treadmill. The systems and devices disclosed herein enable an exerciser to adjust operational parameters of an exercise device using an integrated touchscreen exercise device controller that is communicatively connected to the exercise device. The integrated touchscreen exercise device controller receives user input indicating which virtual buttons and/or operational parameters are to be changed on the touchscreen interface and/or the exercise device. The touch inputs may alter the way a button appears, or may quickly adjust a setting while the user is exercising.

Exercise devices typically only provide one level of step increments for changing operational settings (e.g. tenths of a mile per hour or tenths of a degree incline). By providing virtual buttons that allow a user to zoom to substantially any range, the systems and methods disclosed herein allow a user to have very fine-grained control over the operational parameters of the exercise machine. The user may, for example, zoom in until speed or incline is controlled in hundredths or thousandths of a mile per hour or degree incline. The user may zoom back out as desired. The level of zoom may be set individually for each button and each operational setting may have its own button.

The virtual buttons also allow users to quickly adjust settings while exercising. For example, instead of pushing a hardware button multiple times to increase or decrease speed (for example), a user can simply touch a virtual button displayed in the integrated touchscreen exercise device controller and slide their finger up or down. When the user stops sliding their finger, the operational setting is set for the level indicated by the user's finger's current position. Accordingly, a setting may be easily adjusted up or down or in some other fashion simply by sliding a finger over the virtual button to the desired setting.

While embodiments of the invention have been described in the context of a motorized treadmill, it is understood that the invention is not limited to any particular type of exercise device. Accordingly, the term "exercise device" shall refer broadly to any type of device that takes the form of an exercise machine, including, but not limited to, treadmills, exercise cycles, Nordic style ski exercise devices, rowers, steppers, hikers, climbers, and elliptical or striding exercise devices. These various types of exercise devices may include touchscreen interfaces as described that allow users to modify operational settings of the exercise device.

I claim:

1. A touchscreen exercise device controller that is connected to an exercise device, the touchscreen exercise device controller being usable to adjust one or more operational parameters relative to the exercise device, the touchscreen exercise device controller comprising:

a touchscreen that performs the following:

displays one or more exercise device controls for controlling exercise device operations; and receives touch inputs from an exercise device user that indicate which exercise device operations are to be changed; and a processing module that performs the following:

generates operational commands for the exercise device based on the received user inputs; and upon determining that one or more of the touch inputs comprises a predefined touch input, modifies at least a portion of the exercise device controls displayed on the touchscreen;

the touchscreen displaying a range of numbers associated with the at least one operating parameter, comprising:

a minimum value;

a maximum value; and numbers between the maximum value and the minimum value spread apart by an incremental value;

wherein at least one of the predefined touchscreen inputs includes using at least two fingers to change the minimum value and the maximum value of the range of numbers and to change the incremental value.

2. The touchscreen exercise device controller of claim 1, wherein at least one of the predefined touchscreen inputs comprises pinching the touchscreen with the at least two fingers.

3. The touchscreen exercise device controller of claim 2, wherein modifying at least a portion of the exercise device controls displayed on the touchscreen comprises zooming in from a higher incremental value to a lower incremental value.

4. The touchscreen exercise device controller of claim 3, wherein zooming in from a higher incremental value to a lower incremental value comprises zooming from mile per hour increments to tenth of a mile per hour increments.

5. The touchscreen exercise device controller of claim 3, wherein zooming in from a higher incremental value to a lower incremental value comprises zooming from half-degree incline increments to tenth of a degree incline increments.

6. The touchscreen exercise device controller of claim 3, wherein the exercise device controls comprise a range of numbers spanning from a first number to a second number.

7. The touchscreen exercise device controller of claim 6, wherein zooming in from a higher incremental value to a lower incremental value comprises zooming in toward the portion of the range of numbers pinched by the user.

8. The touchscreen exercise device controller of claim 6, wherein the user touches a number on the range of numbers to select a speed for the exercise device.

9. The touchscreen exercise device controller of claim 6, wherein the user touches a number on the range of numbers to select a degree of incline for the exercise device.

10. The touchscreen exercise device controller of claim 6, wherein the user slides a finger over the range of numbers on the touchscreen to change a specified operational setting.

11. The touchscreen exercise device controller of claim 6, wherein the user slides a finger upward over the range of numbers to increase a specified operational setting and downward over the range of numbers to decrease the specified operational setting.

12. The touchscreen exercise device controller of claim 1, wherein at least one of the predefined touchscreen inputs comprises touching the touchscreen with the at least two fingers and spreading the fingers apart from each other.

13. The touchscreen exercise device controller of claim 12, wherein modifying at least a portion of the exercise device controls displayed on the touchscreen comprises zooming out from a lower incremental value to a higher incremental value.

14. The touchscreen exercise device controller of claim 13, wherein the exercise device controls comprise a range of numbers spanning from a first number to a second number.

15. The touchscreen exercise device controller of claim 14, wherein zooming out from a lower incremental value to a higher incremental value comprises zooming out toward the portion initially touched by the user.

16. The touchscreen exercise device controller of claim 1, wherein changing the range is commensurate with a degree to which the two fingers are spread apart from one another.

17. The touchscreen exercise device controller of claim 1, wherein changing the range includes changing the range from a tenths scale to a hundredth scale.

* * * * *